US008680415B2

(12) United States Patent
Fang et al.

(10) Patent No.: US 8,680,415 B2
(45) Date of Patent: Mar. 25, 2014

(54) MICRO-SWITCH EMPLOYING LEVER PRINCIPLE

(75) Inventors: Ding-Jie Fang, New Taipei (TW); Gang-Wei Liao, New Taipei (TW)

(73) Assignee: Zippy Technology Corp., New Taipei (TW)

( * ) Notice: Subject to any disclaimer, the term of this patent is extended or adjusted under 35 U.S.C. 154(b) by 114 days.

(21) Appl. No.: 13/447,880

(22) Filed: Apr. 16, 2012

(65) Prior Publication Data

US 2013/0270085 A1 Oct. 17, 2013

(51) Int. Cl.
*H01H 5/18* (2006.01)

(52) U.S. Cl.
USPC ..... 200/461

(58) Field of Classification Search
USPC ..... 200/461, 467, 520
IPC ..... H01H 3/26,13/38, 13/40
See application file for complete search history.

(56) References Cited

U.S. PATENT DOCUMENTS

| | | | | |
|---|---|---|---|---|
| 5,459,295 | A * | 10/1995 | Ohta et al. | 200/461 |
| 6,864,453 | B1 * | 3/2005 | Yu | 200/520 |
| 7,932,475 | B2 * | 4/2011 | Schnodt | 200/461 |
| 2013/0231007 | A1 * | 9/2013 | Iwamoto et al. | 439/620.21 |

FOREIGN PATENT DOCUMENTS

| | | |
|---|---|---|
| CN | 202110987 U | 1/2012 |
| TW | 592380 | 6/2004 |

* cited by examiner

*Primary Examiner* — Vanessa Girardi
(74) *Attorney, Agent, or Firm* — Muncy, Geissler, Old & Lowe, P.C.

(57) ABSTRACT

A labor-saving micro-switch comprises a housing, a press member located on the housing, an actuation member located in the housing and a driven member located between the press member and actuation member. The press member is depressible to move reciprocally in a displacement inside the housing. The driven member includes a pivotal portion hinged on the housing in a swivelable manner, a force-receiving portion opposite to the pivotal portion in the displacement and a force-applying portion driven by the force-receiving portion and movable about the pivotal portion serving as a fulcrum to press the actuation member. The driven member drives the actuation member to switch between a first conductive state and a second conductive state through a lever principle. The micro-switch thus formed can achieve higher sensitivity and reduce production cost.

10 Claims, 6 Drawing Sheets

MICRO-SWITCH EMPLOYING LEVER PRINCIPLE

FIELD OF THE INVENTION

The present invention relates to a micro-switch and particularly to a labor-saving micro-switch to perform switching through a lever principle.

BACKGROUND OF THE INVENTION

Micro-switch provides many advantages such as smaller size and withstanding depressing for millions of times, thus is widely used on 3C electronic products, home appliances and vehicles. Simply speaking, the micro-switch is a control element to set a circuit ON or OFF. Its structure generally includes a holder and a switch assembly and an operation assembly located in the holder. The switch assembly includes a common terminal, a normal-closed terminal and a normal-open terminal. The operation assembly includes a movable member and a pushbutton. The movable member has one end connected to the common terminal. The pushbutton is moved up and down to allow another end of the movable member to sway between the normal-closed terminal and normal-open terminal to switch different connection and conductive states.

A conventional micro-switch such as R.O.C. patent No. 592380 mainly includes an upper lid and a base. The micro-switch also includes a pushbutton, a first pin, a second pin and a conductive reed fastened to the first pin. The pushbutton is depressible downwards onto one end of the conductive reed so that another end of the conductive reed is swayed downwards to connect to the first pin and second pin to generate a switch signal. While it can provide circuit switch function, it relies merely on the conductive reed to bear the downward pressure and provide an elastic force. After used for a prolonged period of time the reed tends to fatigue because of frequent bending up and down and fracture, and result in failure for switching circuit or sending signals.

To remedy the aforesaid shortcoming, China patent No. CN202110987 discloses a micro-switch. Referring to FIG. 1, it mainly comprises a housing 1, a plurality of conductive terminals 2 located on the housing 1, an elastic element 3, a conductive reed 4 and a pushbutton 5. The conductive reed 4 has a pressed portion 41 to be pressed by the pushbutton 5, a contact portion 42 located between the conductive terminals 2, and two connection ribs 43 to bridge the pressed portion 41 and contact portion 42. The elastic element 3 bridges the conductive reed 4 and conductive terminals 2. The conductive reed 4 is supported by the elastic element 3 in normal conditions. The elastic element 3 provides a bracing force for the conductive reed 4 to prevent it from incurring fatigue and fracturing caused by repetitive up and down bending. Therefore the conductive reed 4 has a longer lifespan and can withstand an increased number of depressing. Although it resolves the problem of easy fatigue and fracturing of the conductive reed mentioned above, it still has the following drawbacks remained to be overcome:

First, its contact portion is movable reciprocally between a normal position and a triggering position to switch different connection and conductive states, hence the conductive reed must be formed at a length to connect the pushbutton and conductive terminals. Nowadays technology industry generally has a very low gross profit margin in doing business, reducing metal consumption of the conductive reed can help to reduce production cost and improve the gross profit margin of products. Moreover, during operation of the micro-switch, the pushbutton presses the pressed portion to make the contact portion to sway downwards. Since the conductive reed is formed at a certain length, the pushbutton has to be pushed by a sufficient force to make the contact portion to sway a sufficient range to switch to and fro to different conductive states. In addition, a high current is frequently generated when the contact portion and conductive terminals are contacted and the high current could cause heat on the contact surface to melt part of the contact portion and stick to the conductive terminals. To separate the contact portion from the conductive terminals to switch different connection and conductive states requires a greater pressing force. As a result, the sensitivity of the micro-switch deteriorates. Hence there are still rooms for improvement on the conventional micro-switch structure, especially in terms of reducing the production cost and switching different conductive states through a smaller force.

SUMMARY OF THE INVENTION

The primary object of the present invention is to overcome the disadvantages of insufficient sensitivity and difficulty in reducing production cost in the conventional micro-switch.

To achieve the foregoing object, the invention provides a labor-saving micro-switch which comprises a housing, a press member located on the housing and a driven member. The housing has a housing compartment inside, a conductive terminal and a common terminal extended outwards from the housing compartment, and an actuation member coupled with the common terminal. The actuation member has a butting portion at one side of the common terminal and a connecting portion at another side of the common terminal. The connecting portion has a first conductive state connecting to the conductive terminal and a second conductive state without connecting to the conductive terminal. The press member is depressible to move reciprocally in a displacement inside the housing between an original position and a pressed position. The driven member is located between the press member and actuation member, and includes a pivotal portion hinged on the housing in a swivelable manner, a force-receiving portion opposite to the pivotal portion in the displacement and a force-applying portion driven by the force-receiving portion to move about the pivotal portion which serves as a fulcrum. The force-receiving portion receives pressing of the press member to drive the force-applying portion to push the butting portion and move the connecting portion to switch between the first conductive state and second conductive state.

In one embodiment the driven member includes a rocking arm connected to the pivotal portion, force-receiving portion and force-applying portion.

In another embodiment the housing includes a holding shaft and the pivotal portion is a sleeve coupled on the holding shaft in a swivelable manner.

In yet another embodiment the housing includes a positioning hole and the pivotal portion is a shaft hinged in the positioning hole in a swivelable manner.

In yet another embodiment the force-receiving portion and pivotal portion are spaced from each other at a distance greater than that between the force-applying portion and pivotal portion.

In yet another embodiment the conductive terminal has two sets to be a first conductive terminal and a second conductive terminal located below and corresponding to the first conductive terminal in the housing compartment of the housing. The connecting portion is connected to the second conductive terminal in the second conductive state.

In yet another embodiment the press member includes a press portion and an elastic element bracing the press portion in normal conditions. The housing includes a channel to allow the press portion to move reciprocally therein, and the press portion has at least one retaining section at the bottom formed at a width greater than that of the channel.

In yet another embodiment the actuation member includes a bracing portion movable about the common terminal serving as a fulcrum to push the connecting portion to connect to the conductive terminal in normal conditions.

In yet another embodiment the housing includes a holder to hold the common terminal and conductive terminal, and a lid to cover the holder.

By means of the structure set forth above, compared with the conventional techniques, the labor-saving micro-switch of the invention provides features as follows:

1. High switch sensitivity. The invention has a driven member located between the press member and actuation member. The driven member includes a pivotal portion hinged on the housing in a swivelable manner, a force-receiving portion opposite to the pivotal portion in the displacement and a force-applying portion driven by the force-receiving portion to move about the pivotal portion serving as a fulcrum. As the press portion takes the force-receiving portion and the pivotal portion respectively as a force applying point and a fulcrum, and the distance between the force-receiving portion and pivotal portion is greater than that between the force-applying portion and pivotal portion, a small force exerting to the force-receiving portion can generate multiplying effect on the force-applying portion, thus users can only exert a small force on the press portion to switch the micro-switch. In another aspect, the sensitivity of the invention also improves.

2. Saving production cost. According to the invention, the press portion drives the actuation member via the driven member and can achieve switching effect without making contact to the actuation member. Hence the actuation member does not need to be formed at a greater length to connect the press portion and common terminal. As a result, the actuation can be made smaller and lighter to save consumption of metal material, and the production cost is lower.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
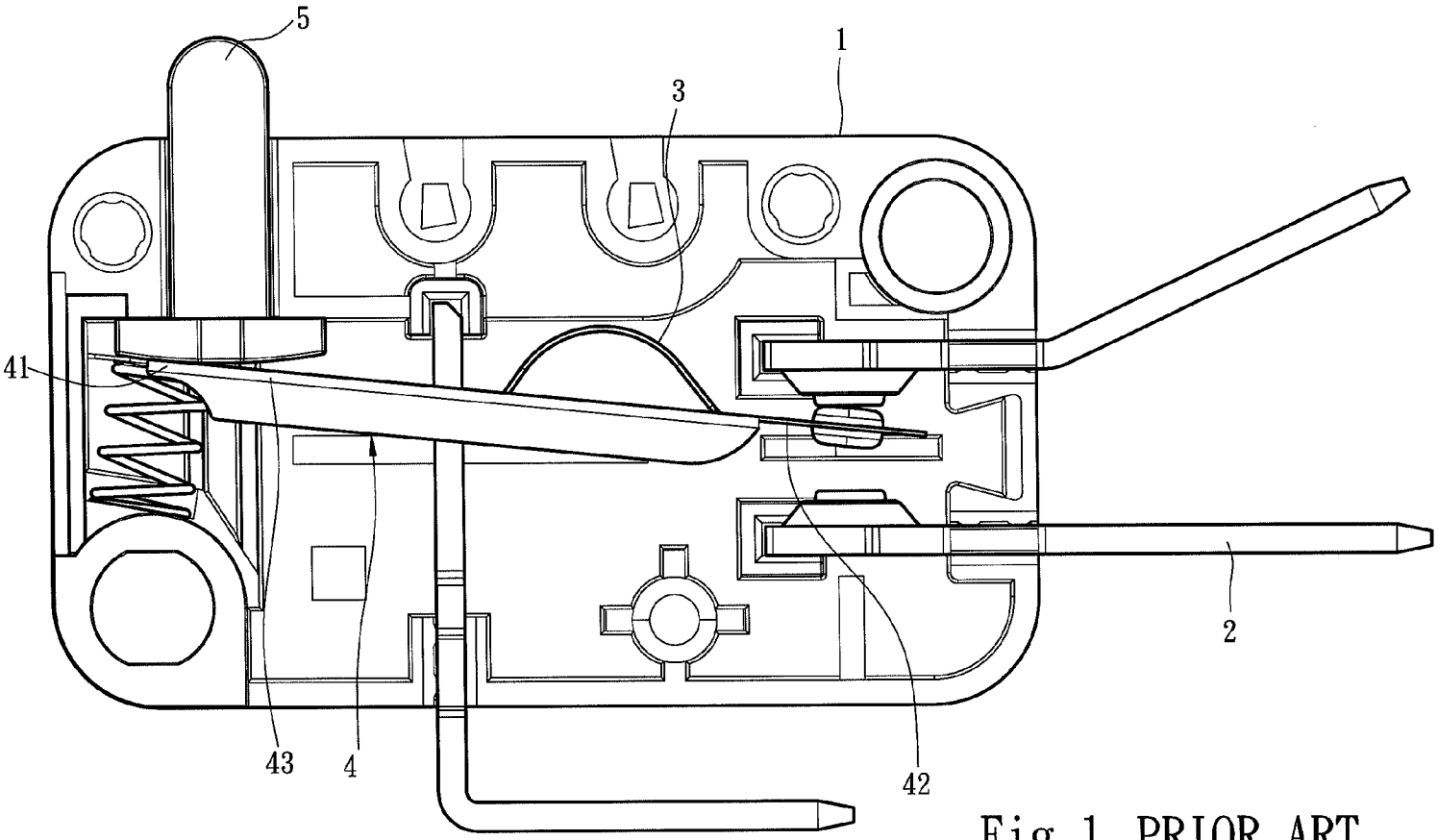
Fig. 1 PRIOR ART
FIG. 1 is a front view of the structure of a conventional micro-switch.
Figure 2:
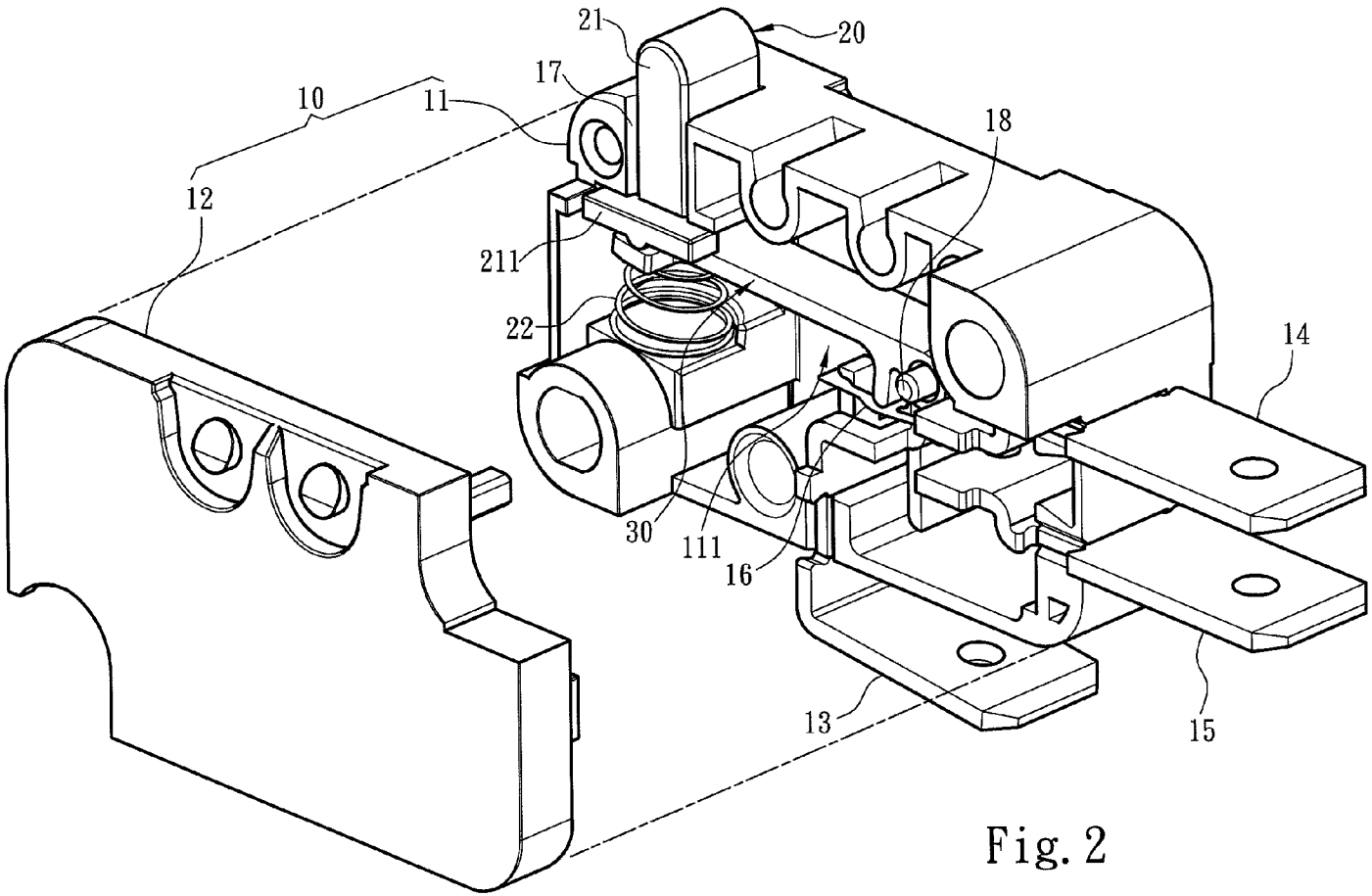
FIG. 2 is a schematic view of the structure of an embodiment of the invention.
Figure 3:
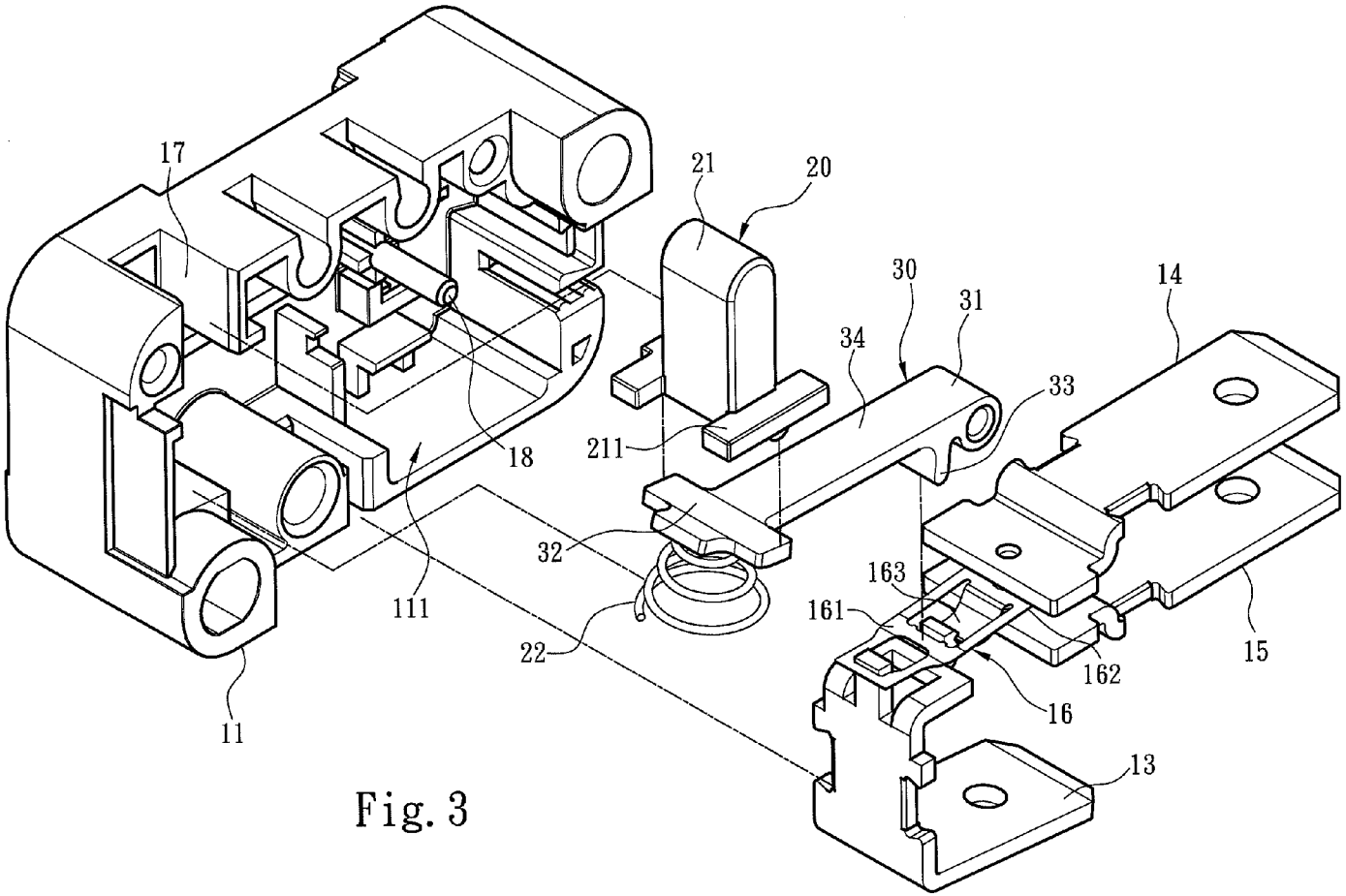
FIG. 3 is an exploded view of an embodiment of the invention.

Please refer to FIGS. 2 and 3 for an embodiment of the invention. The labor-saving micro-switch according to the invention mainly includes a housing 10 and a press member 20 located on the housing 10. The housing 10 includes a holder 11 and a lid 12 to cover the holder 11. The holder 11 has a housing compartment 111 inside, and a common terminal 13 and a first conductive terminal 14 extended outwards from the housing compartment 111, and also a second conductive terminal 15 located below and corresponding to the first conductive terminal 14 in the housing compartment 111. The housing 10 further has an actuation member 16 coupled with the common terminal 13 and a driven member 30 located between the press member 20 and actuation member 16. The press member 20 includes a press portion 21 and an elastic element 22 bracing the press member 21 in normal conditions. The housing 10 also has a channel 17 to allow the press member 20 to move reciprocally therein so that the press member 20 can move reciprocally in a displacement between an original position and a pressed position inside the housing 10. To prevent the press member 20 from escaping the housing 10, the press portion 21 has at least one retaining section 211 at the bottom formed at a width greater than that of the channel 17. In this embodiment, the first conductive terminal 14 is a normal-closed terminal and the second conductive terminal 15 is a normal-open terminal, but they are not the limitation of the invention.

Figure 4:
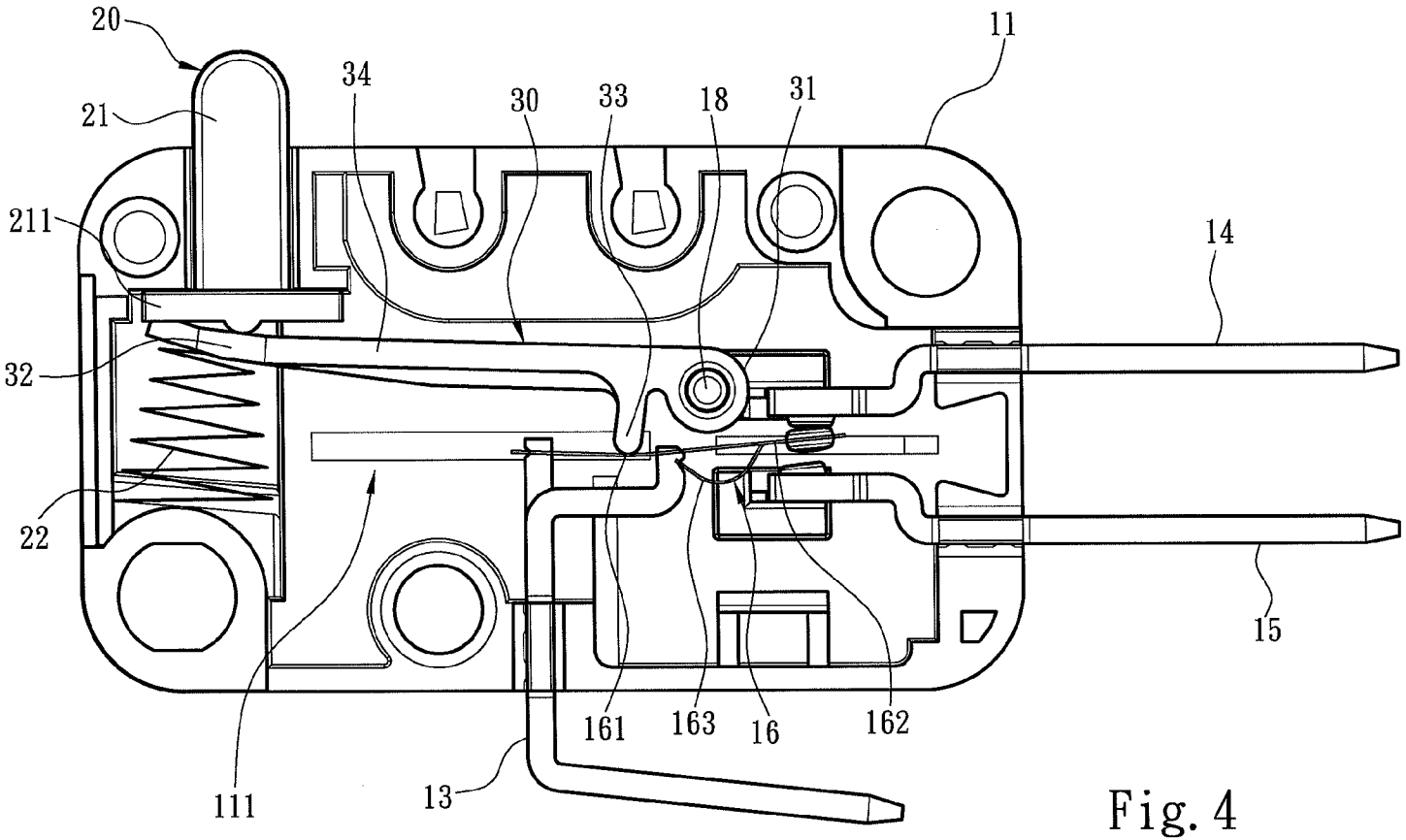
FIG. 4 is a front view of the structure of an embodiment of the invention.
Figure 6:
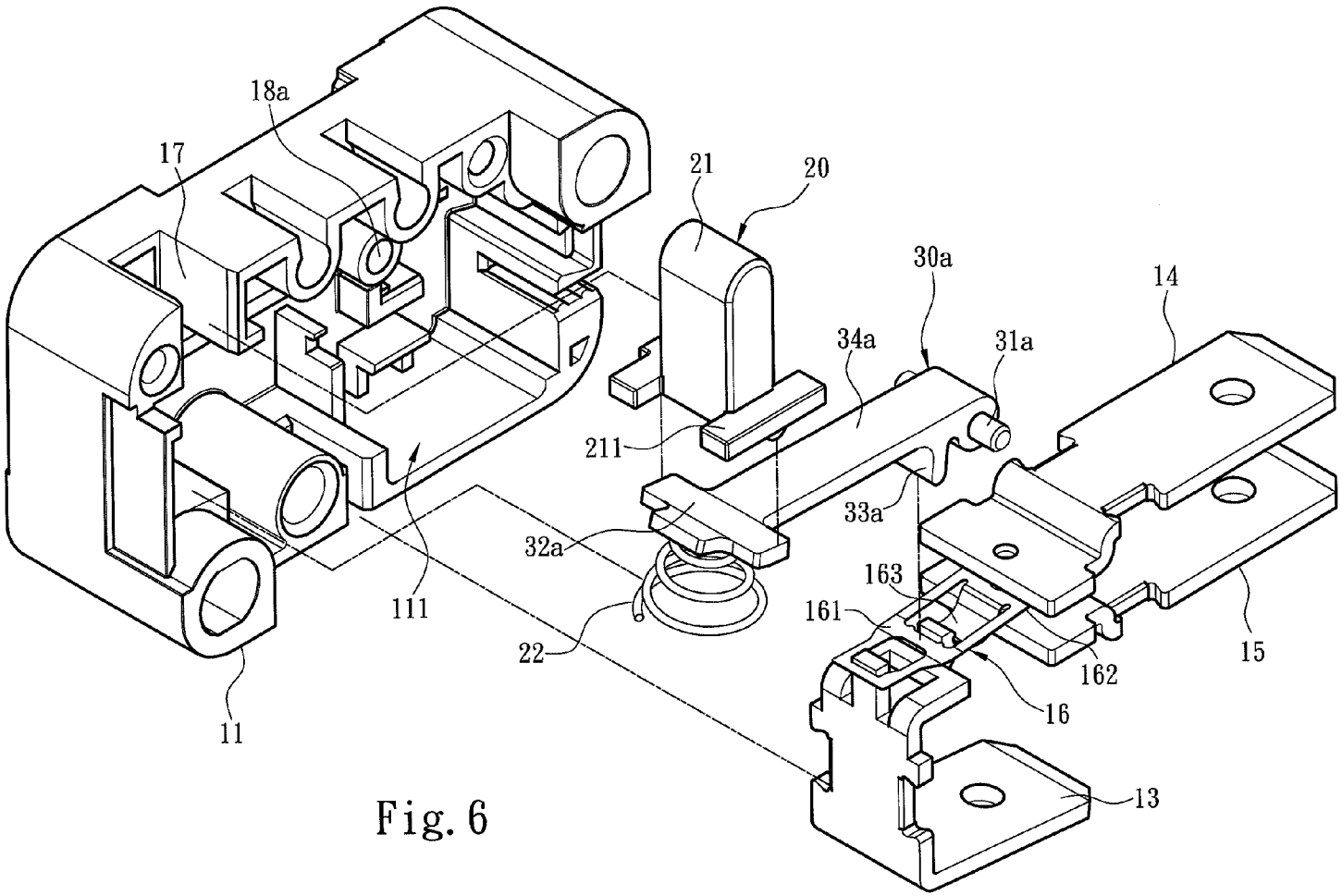
FIG. 6 is an exploded view of another embodiment of the invention.

Also referring to FIG. 4, the housing 10 also has a holding shaft 18. The driven member 30 has a pivotal portion 31 coupled on the holding shaft 18 in a swivelable manner, a force-receiving portion 32 opposite to the pivotal portion 31 in the displacement, a force-applying portion 33 driven by the force-receiving portion 32 to move about the pivotal portion 31 serving as a fulcrum, and a rocking arm 34 connecting to the pivotal portion 31, force-receiving portion 32 and force-applying portion 33. Preferably, the force-applying portion 33 is located between the force-receiving portion 32 and pivotal portion 31, but this is not the limitation. Furthermore, in this embodiment, the actuation member 16 has a butting portion 161 at one side of the common terminal 14 and a connecting portion 162 at another side of the common terminal 13. The actuation member 16 further has a bracing portion 163 movable about the common terminal 13 serving as a fulcrum to push the connecting portion 162 to connect to the first conductive terminal 14 in normal conditions. It is to be noted that in this embodiment the holding shaft 18 is located in the housing 10 and the pivotal portion 31 may be a sleeve coupled on the holding shaft 18 in a swivelable manner. The invention also can be formed in other types of embodiments to substitute the one previously discussed. FIG. 6 illustrates another embodiment in which the housing 10 includes a positioning hole 18*a*, and the pivotal portion 31*a* is a turnable shaft hinged in the positioning hole 18*a*. Correspondingly, the driven member 30*a* includes a force-receiving portion 32*a* opposite to the pivotal portion 31*a* in the displacement, a force-applying portion 33*a* driven by the force-receiving portion 32*a* to move about the pivotal portion 31*a* serving as a fulcrum, and a rocking arm 34*a* connecting to the pivotal portion 31*a*, force-receiving portion 32*a* and force-applying portion 33*a*. The force-receiving portion 32*a* and pivotal portion 31*a* are spaced from each other at a distance greater than that between the force-applying portion 33*a* and pivotal portion 31*a*. Other elements and structure are same as previously discussed, thus details are omitted.

Please refer to FIG. 4 again, the press portion 21 has a displacement of reciprocally moving between the original position and pressed position in the channel 17 inside the housing 10. A user can push the press portion 21 downwards in the channel 17. When the press portion 21 is not pressed, the elastic element 22 provides an elastic force to push the force-receiving portion 32 upwards to drive the force-applying portion 33 to contact lightly the butting portion 161 of the actuation member 16, while the bracing portion 163 moves about the common terminal 13 serving as the fulcrum and provides an elastic force to push the connecting portion 162 to connect to the first conductive terminal 14 in the normal conditions so that the common terminal 13 and first conductive terminal 14 are connected to form a first conductive state. In this embodiment, the first conductive terminal 14 is the normal-closed terminal, hence in the first conductive state the micro-switch does not generate a switch signal to the load at the rear end.

Figure 5:
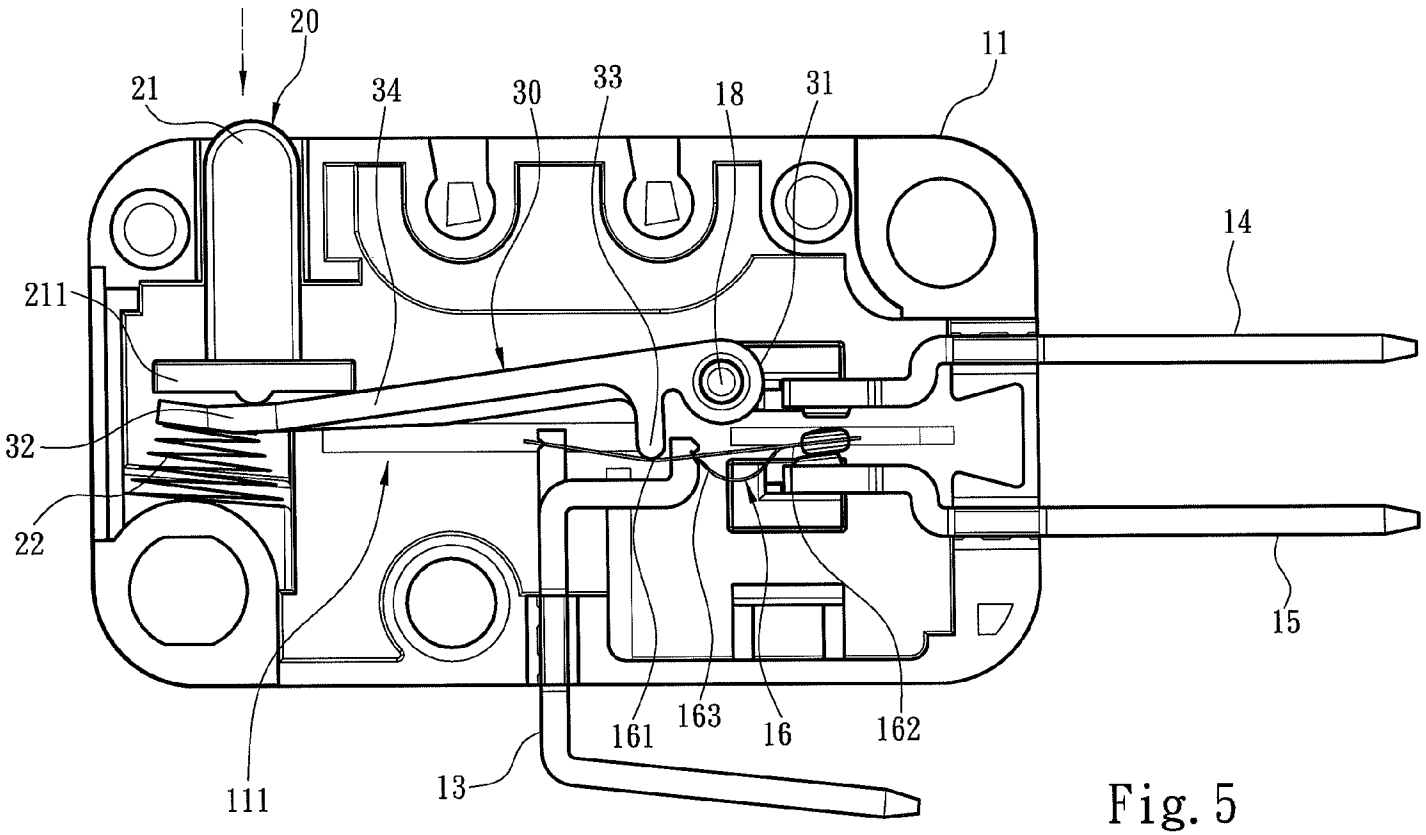
FIG. 5 is a schematic view of an embodiment of the invention in an operating condition.

Please refer to FIG. 5 for an operating condition of an embodiment of the invention. When the press portion 21 is moved downwards from the original position to the pressed position, the force-receiving portion 32 in the displacement is pressed by the press portion 21 to compress the elastic element 22, and then the force-applying portion 33 is driven by the force-receiving portion 32 to swivel counterclockwise about the pivotal portion 31 serving as the fulcrum, thereby pushes the butting portion 161 downwards. Because the pressing force is greater than the upward elastic force provided by the bracing portion 163, the connecting portion 162 also is moved downwards with the butting portion 161; meanwhile, the connecting portion 162 escapes from the first conductive terminal 14 and connects to the second conductive terminal 15 so that the common terminal 13 and second conductive terminal 15 are connected to form a second conductive state. In this embodiment, the second conductive terminal 15 is a normal-open terminal. Hence in the second conductive state the micro-switch generates a switch signal to the load at the rear end.

The operation mechanism depicted in FIGS. 4 and 5 can be explained according to a lever principle. The force-receiving portion 32 and rocking arm 34 of the driven member 30 serve respectively as a force applying point and arm of force, and the press portion 21 moves about the pivotal portion 31 serving as a fulcrum to press the force-receiving portion 32 to generate a moment of force to drive the force-applying portion 33. Since the distance between the force-receiving portion 32 and pivotal portion 31 is greater than that between the force-applying portion 33 and pivotal portion 31, the force exerting on the force-receiving portion 32 can generate multiplying effect on the force-applying portion 33. As a result, a user can only exert a small force on the press portion 21 to switch the micro-switch, namely, the micro-switch can achieve labor-saving switching effect through the lever principle.

As a conclusion, the labor-saving micro-switch of the invention provides a driven member between the actuation member and press member. The driven member includes a pivotal portion hinged on the housing in a swivelable manner, a force-receiving portion opposite to the pivotal portion in the displacement and a force-applying portion driven by the force-receiving portion to move about the pivotal portion serving as a fulcrum. Through such a structure, the press member can drive the connecting portion through the driven member to switch between a first conductive state and a second conductive state. Moreover, the driven member for labor-saving switching can be designed by adopting the lever principle to switch the micro-switch with a small force. The micro-switch thus formed can be used in any electronic devices that require higher sensitivity. In addition, since the actuation is driven by the press member via the driven member, the actuation member does not need to form direct contact with the press member, hence can be made smaller and lighter to reduce usage of metal material and make the production cost lower. It provides significant improvements over the conventional techniques.

While the preferred embodiments of the invention have been set forth for the purpose of disclosure, they are not the limitations of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A micro-switch employing lever principle, comprising:

a housing including a housing compartment inside, at least one conductive terminal and a common terminal extended outwards from the housing compartment, and an actuation member coupled with the common terminal; the actuation member including a butting portion at one side of the common terminal and a connecting portion at another side of the common terminal, the connecting portion including a first conductive state connecting to the conductive terminal and a second conductive state not connecting to the conductive terminal;

a press member which is located on the housing and depressible to move reciprocally in a displacement inside the housing between an original position and a pressed position; and a driven member which is located between the press member and the actuation member and includes a pivotal portion hinged on the housing in a swivelable manner, a force-receiving portion opposite to the pivotal portion in the displacement and a force-applying portion driven by the force-receiving portion to move about the pivotal portion serving as a fulcrum, the force-receiving portion being depressible by the press member to drive the force-applying portion to press the butting portion so that the butting portion then drives the connecting portion to switch between the first conductive state and the second conductive state.

2. The micro-switch of claim 1, wherein the driven member includes a rocking arm connecting to the pivotal portion, the force-receiving portion and the force-applying portion.

3. The micro-switch of claim 1, wherein the housing includes a holding shaft and the pivotal portion is a sleeve coupled on the holding shaft in a swivelable manner.

4. The micro-switch of claim 1, wherein the housing includes a positioning hole and the pivotal portion is a shaft hinged in the positioning hole in a swivelable manner.

5. The micro-switch of claim 1, wherein the force-receiving portion and the pivotal portion are spaced from each other at a distance greater than that between the force-applying portion and the pivotal portion.

6. The micro-switch of claim 1, wherein the conductive terminal includes a first conductive terminal and a second conductive terminal located below and aligned with the first conductive terminal in the housing compartment of the housing, the connecting portion connecting to the second conductive terminal in the second conductive state.

7. The micro-switch of claim 1, wherein the press member includes a press portion and an elastic element bracing the press portion in normal conditions.

8. The micro-switch of claim 7, wherein the housing includes a channel to allow the press portion to move reciprocally therein, the press portion including at least one retaining section at the bottom thereof formed at a width greater than that of the channel.

9. The micro-switch of claim 1, wherein the actuation member includes a bracing portion movable about the common terminal serving as a fulcrum to push the connecting portion to connect to the conductive terminal in normal conditions.

10. The micro-switch of claim 1, wherein the housing includes a holder to hold the common terminal and the conductive terminal, and a lid to cover the holder.

* * * * *